US005784832A

United States Patent [19]

LeeVan

[11] Patent Number: 5,784,832

[45] Date of Patent: Jul. 28, 1998

[54] SELF ALIGNING WINDOW REGULATOR

[75] Inventor: Michael F. LeeVan, South Bend, Ind.

[73] Assignee: Excel Industries, Inc., Elkhart, Ind.

[21] Appl. No.: 746,826

[22] Filed: Nov. 18, 1996

[51] Int. Cl.[6] ..... E05F 11/48

[52] U.S. Cl. ..... 49/352; 49/348

[58] Field of Search ..... 49/352, 452, 348, 49/349, 351

[56] References Cited

U.S. PATENT DOCUMENTS

| | | | |
|---|---|---|---|
| 3,333,363 | 8/1967 | Garvey | 49/352 |
| 4,299,057 | 11/1981 | Hagemann et al. | 49/375 |
| 4,633,613 | 1/1987 | Kobayashi et al. | 49/352 X |
| 4,694,610 | 9/1987 | Hornivius | 49/375 X |
| 4,706,412 | 11/1987 | Kobrehel | 49/352 |
| 4,794,733 | 1/1989 | Kanemaru | 49/375 X |
| 4,908,988 | 3/1990 | Yamamura et al. | 49/349 X |
| 5,038,519 | 8/1991 | Huebner . | |
| 5,074,077 | 12/1991 | Toyoshima et al. . | |
| 5,469,663 | 11/1995 | TenBrink et al. . | |
| 5,502,926 | 4/1996 | Grace et al. . | |

FOREIGN PATENT DOCUMENTS

| | | | |
|---|---|---|---|
| 6137023 | 5/1994 | Japan | 49/375 |

*Primary Examiner*—Jerry Redman
*Attorney, Agent, or Firm*—Banner & Witcoff, Ltd.

[57] ABSTRACT

A self-aligning window regulator for raising and lowering a windowpane in a motor vehicle door, having a rail attached to the door and a glider slidable in a generally up and down direction on the rail. At least one slide is preferably snugly received in a C- channel to allow for fore and aft adjustment of the windowpane to accommodate for dimensional variations and misalignment of the window regulator and the door componentry. In one embodiment, the C-channel is attached to the windowpane and the slide is attached to the glider. In another embodiment, the C-channel is attached to the glider and the slide is attached to the windowpane. A pin such as a rivet may be used to secure the slide to the rest of the regulator, and the rivet may allow the slide to pivot, providing for inboard and outboard adjustment.

7 Claims, 5 Drawing Sheets

SELF ALIGNING WINDOW REGULATOR

FIELD OF THE INVENTION

The present invention generally relates to mechanisms controlling the motion of windowpanes in motor vehicles, and more particularly to an enhanced design allowing for a windowpane to float relative a window regulator, that is, enabling the windowpane, within a certain range to self-align by changing its position relative to the door to prevent binding and minimize seal wear.

BACKGROUND OF THE INVENTION

Window regulators are used to control the motion of a windowpane, such as the glass that is positioned in the door of a motor vehicle. One example of a window regulator is the cable and drum variety, which typically has a cable connected between a drive means, including a rotatable drive drum, and a glider which is rigidly attached to windowpane connecting componentry. The glider slides in a generally up and down direction over a rail. The rail typically is rigidly attached to an upper and lower door mounting bracket.

It is preferable that the windowpane slide in channels to guide the glass with seals to keep out the elements and to reduce wind noise. Several flaws can result in window regulator assemblies when they are installed into the motor vehicle door, resulting in a slowing of the rate of travel of the windowpane sliding in the door and rapid seal wear. If the problems are severe enough, the windowpane may even jam. Specific flaws that may lead to these problems include, for example, that the channels may not be completely parallel with both one another and with the rail, the door may be otherwise misaligned, the window regulator componentry may not be of the proper dimensions, stack-up tolerances between regulator componentry may exceed design allowance, or any combination of these.

Previous attempts to address the problems associated with stack-up tolerance errors and misalignment include specifying the order of assembly of the window regulator in the motor vehicle door and enlarging the mounting holes into slots at which the upper door mounting bracket is attached in the door. In such cases, the regulator is first attached to the door at the lower mounting bracket. Next, the regulator is attached to the windowpane. Then the regulator is cycled to the full up position. Only then is the regulator attached to the door at the upper mounting bracket. However, once the rivets are attached at the upper door mounting bracket the regulator is rigidly fixed to the door. If misalignment or tolerance errors exist, the aforesaid problems of premature seal wear, slow travel times and, in extreme cases, the windowpane jamming in the run channels can still occur.

Another proposed solution to the problem of binding and seal wear is disclosed in U.S. Pat. No. 5,038,519 to Huebner which teaches a spring mounted pin attached to a carrier. The pin extends through a slot in a bracket which is in turn affixed to a metal plate carrying the windowpane. Spring washers between the free end of the pin and the bracket resist, but allow, relative movement between the bracket and the carrier. This in turn allows the windowpane to have limited fore and aft and inboard-outboard adjustment. However, the number of components in this design makes it relatively complex and difficult to assemble.

In view of the foregoing, it is an object of the present invention to provide a window regulator of simple design which allows the windowpane to cycle properly even in the event of errors in sizes or positioning of the parts or stack up tolerances. It is an object of at least certain preferred embodiments of the present invention to provide a self-aligning window regulator which reduces aesthetically unappealing squeaks and rattles without the use of springs at the glider interface with the window bracketry.

It is another related object of the present invention to provide such a window regulator that is relatively simple to assemble and highly reliable in operation.

SUMMARY

In accordance with these and other objects, there is provided a self-aligning window regulator for raising and lowering a windowpane in a window opening in a motor vehicle door which allows the windowpane to be self-aligning, that is, automatically adjustable in its position relative to the window opening as it travels along its travel path, particularly in the fore-aft directions. Such position adjustment preferably is sufficient to accommodate dimensional variations and misalignment of the window regulator and other componentry of the vehicle door.

The windowpane typically travels up and down in a path defined at least in part by vertically extending run channels having weather seals to keep the elements out of the interior of the motor vehicle and reduce window noise. For cable-drum regulators, a rail is attached to the door and a glider slides generally up and down over the rail. The rail should be generally parallel with the run channels for smooth travel; misalignment can cause slow cycle times, excessive seal wear and/or jamming of the windowpane.

Drive means including a drive motor or hand crank rotates a drive drum. Connecting the drive drum to the glider is at least one cable wrapped around the drum at one end, and connected to the glider at the other end. Operation of the drive means causes the cable to pull on the glider and carry the windowpane between the down and up positions. When the self-aligning feature is used in such regulators, there is provided at least one and preferably two slides snugly received in a C-channel. The slides can move back and forth in the C-channel to accommodate and correct for dimensional variations and misalignment of the window regulator componentry. If, as the windowpane travels along its travel path, it begins to bind against the run channels or the seals, the force will be transmitted back to the slides. The slides will be repositioned in the C-channel and will thereby move relative the rail and the glider. This self-alignment reduces the forces exerted on the seals and channels and thereby provides for the smooth, fluid motion of the windowpane as it travels between the up and down positions.

From the foregoing disclosure and the following more detailed description of various preferred embodiments it will be apparent to those skilled in the art that the present invention provides a significant advance in the technology and art of window regulators, particularly cable-drum window regulators. Particularly significant in this regard is the potential the invention affords for a low cost design that allows at least the windowpane to float. Additional features and advantages of various preferred embodiments will be better understood in view of the detailed description provided below.

Figure 1:
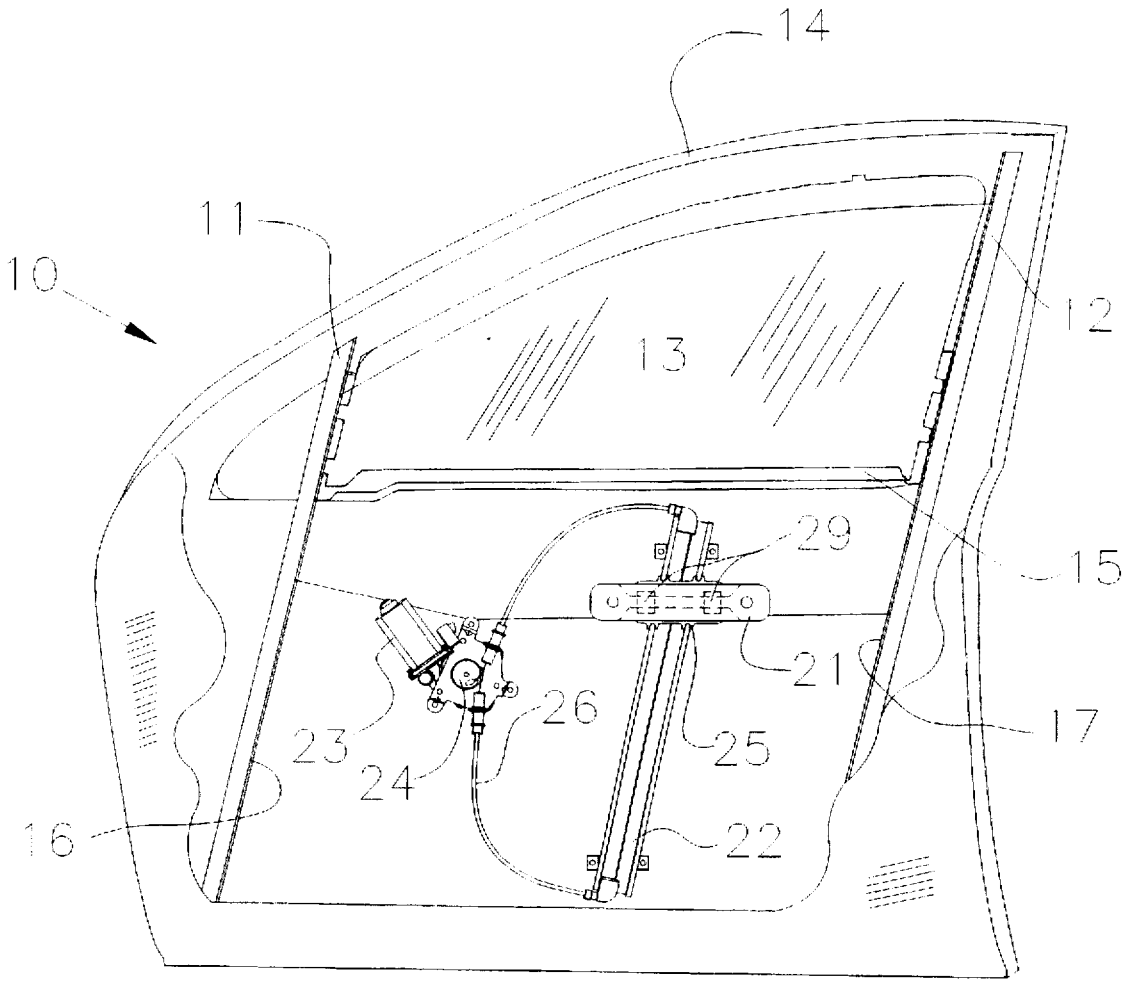
FIG. 1 is an elevation view of a motor vehicle door, partially cut away, revealing a self-aligning window regulator in accordance with a preferred embodiment.

It should be understood that the appended drawings are not necessarily to scale, presenting a somewhat simplified representation of various preferred features illustrative of the basic principles of the invention. The specific design features of a self-aligning window regulator as disclosed here, including, for example, the rivet or pin will be determined in part by the particular intended application and use environment. Certain features of the illustrated embodiments have been enlarged or distorted relative to others to facilitate visualization and clear understanding. In particular, thin features may be thickened, and the dimensions of various components may be modified for clarity of illustration. All references to direction and position, unless otherwise indicated, refer to the orientation of the window regulator illustrated in the drawings. In general, the fore and aft directions refers to left and right directions in the plane of the paper in the side view of FIG. 1, and up, down or vertical refers to corresponding up, and down directions in the plane of the paper in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible self-aligning window regulators disclosed herein. The following detailed discussion of various alternative and preferred features and embodiments will illustrate the general principles of the invention with reference principally to a cable-drum window regulator for use in a motor vehicle. Other embodiments suitable for other applications will be apparent to those skilled in the art given the benefit of this disclosure.

Turning now to the preferred embodiments shown in the drawings, FIGS. 1–4 shows a self-aligning window regulator positioned in the door 10 of a motor vehicle in accordance with a preferred embodiment. The windowpane 13 is positioned in between run channels 11,12 for movement in generally up and down positions within the motor vehicle door from a closed position in which the windowpane 13 contacts the header 14 of the door to an open position. In the case of front doors of motor vehicles the top of windowpane 13 typically can be lowered below the beltline 15 in a full open position. Seals 16,17 may be positioned along the run channels to keep out the elements and to reduce wind noise.

Figure 2:
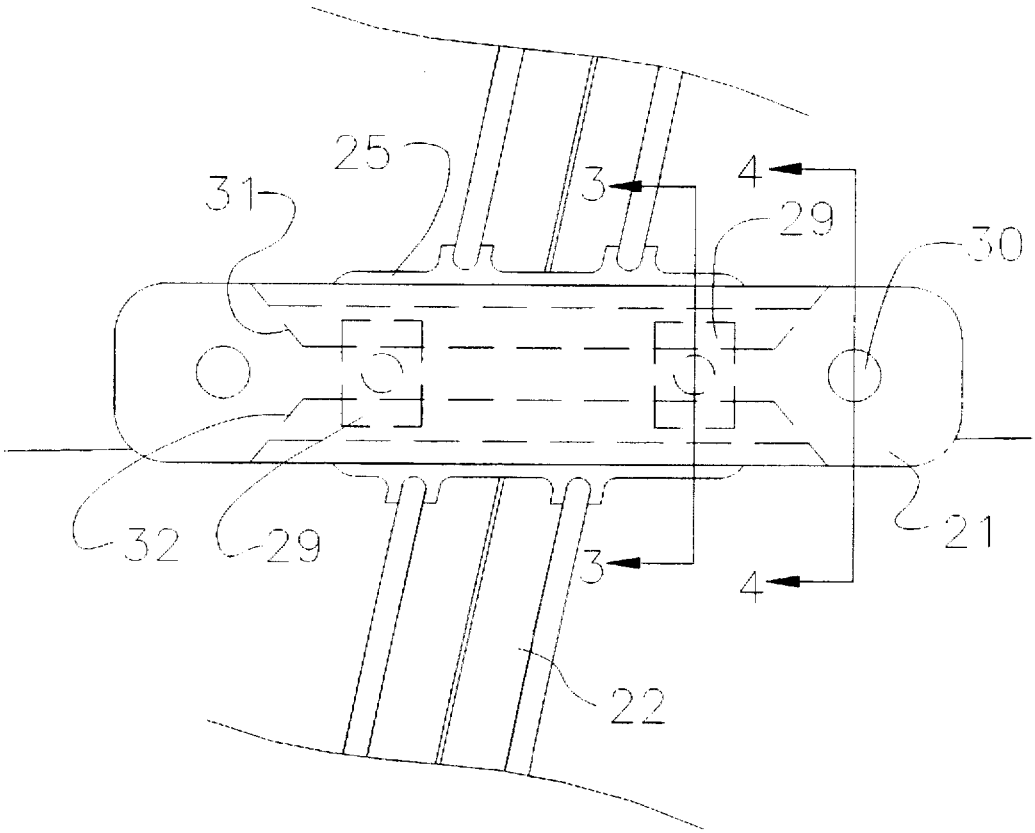
FIG. 2 is an enlarged view of the C-channel and slides of the window regulator of FIG. 1 which allow for adjustment of the windowpane relative other components.
Figure 3:
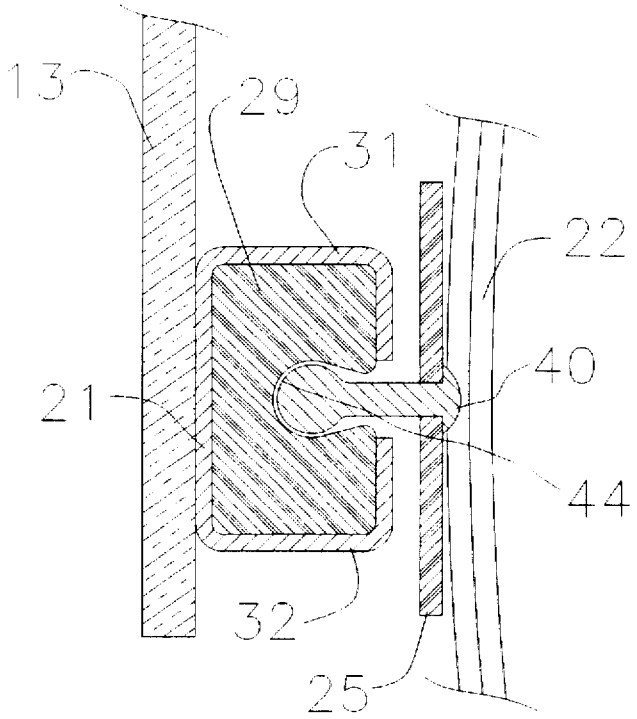
FIG. 3 is a cross section view taken along the line 3—3 in FIG. 2, revealing a pin or rivet securing the slide to the glider.

To raise and lower the windowpane 13, drive means are used including a drive motor 23 and a drive drum 24 rotatable by the drive motor. Cables 26 are attached at one end to the drum and at the other end to a glider 25 which slides up and down on a rail 22 as best seen in FIG. 2. Rotation of the drive drum winds up the cable on one side and unwinds on the other, thereby pulling the windowpane in either up or down directions, depending on the direction of rotation of the drive drum 24.

Figure 4:
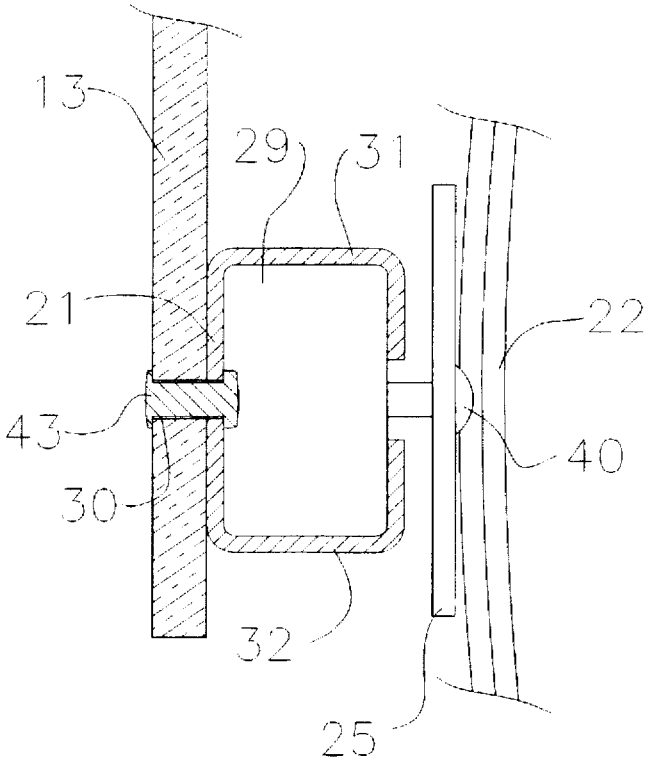
FIG. 4 is a cross section view taken along line 4—4 in FIG. 2, showing a pin securing the C-channel to the windowpane in accordance with a preferred embodiment.

The windowpane run channels 11,12 must be generally parallel with the rail 22 and with each other to prevent the windowpane 13 from biting into either seal 16,17 or jamming during traveling. Moreover, dimensional variations between other parts of the door and the window regulator even when the rail and the run channels are properly aligned can cause the problems mentioned above. To allow the windowpane to self-align, that is, find a smooth travel path in the run channels, there is provided a C-channel 21 which is affixed to the windowpane 13, for example by fasteners 43 in holes 30 as best seen in FIGS. 2 and 4. Optionally, instead of bolting or riveting the C-channel directly to the glass a glass attachment bracket may be bonded to the glass which incorporates a C-channel or other interconnecting bracketry may be employed in accordance with attachment teaching known to those skilled in the art.

At least one slide and preferably two slides 29 are snugly received in the C-channel so as to be slidable in fore and aft directions in the C-channel 21 in response to dimensional variations, misalignment of the window regulator componentry, etc., especially in the run channels 11,12 to allow the windowpane 13 to self-align by movement relative the rail and therefore, relative the window opening. Where two slides are used, they would most preferably be used on opposite sides of the rail 22 as shown in FIG. 2, that is, on generally opposite sides of the vertical axis of the rail such that the various forces are somewhat equalized between the two slides. Upper and lower flanges 31,32 of the C-channel 21 can define a generally rectangular slide receiving area, and the slides 29 are preferably snugly received in the slide receiving area, that is, the edges of the slides preferably contact the flanges 31,32, to minimize the potential for rattle between moving components of the window regulator.

The slides 29 are attached to the glider 25 by, for example, rivet 40. The rivet may optionally have a rounded slide engaging surface 44 (FIG. 3) which allows limited pivotal movement in the inboard-outboard directions. Advantageously, in regulators as disclosed here clips, springs or other biasing members to reduce rattles and other noises preferably are not required, as the slides 29 are snugly received in the C-channel 21. However, slides with projections extending into the C-channel can be used. The slides may be generally rectilinear shaped as in the preferred embodiments shown in the drawings, or they may be generally round. The slide is seen to have a top surface, a bottom surface, an inboard surface and an outboard surface which contact the C-channel flanges 31,32 to fit snugly into the rectangular area defined by the C-channel.

The slide is preferably made of acetal or other similar engineering plastic. The rivet may be inserted into the slide while the material is warm, as in certain conditions the plastic material will spring back to its mold shape to secure the rivet to the slide.

Figure 5:
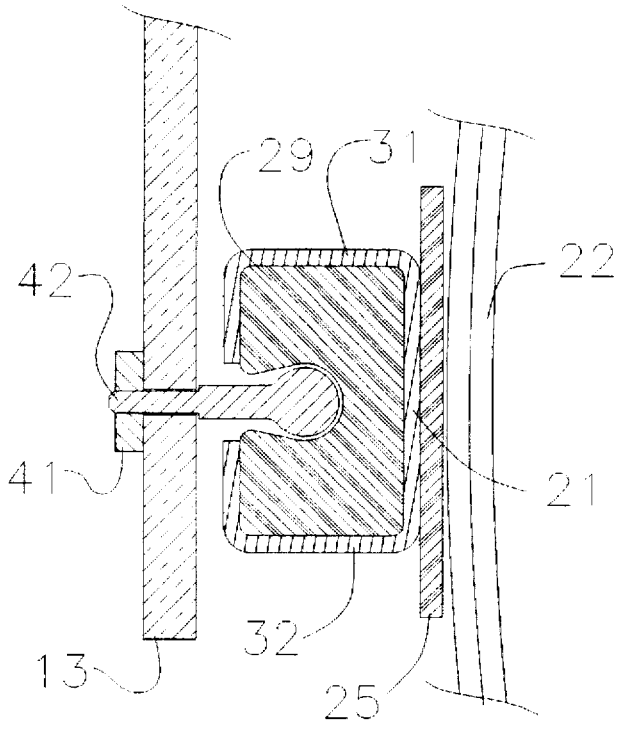
FIG. 5 is a cross section view of an alternative preferred embodiment with the glider/rail attachment removed for clarity of illustration, wherein the C-channel is affixed to the directly to the glider and the slide is pivotally attached to the windowpane.

FIG. 5 shows an alternative preferred embodiment wherein the C-channel 21 is affixed directly to the glider 25, and the slides 29 are attached to the windowpane by a pin 42 and fastener 41.

With the self-aligning feature, as the windowpane cycles and encounters an area where binding begins to occur, the slides allow the windowpane to move away from the high effort position without placing undue stress on the glider as it slides on the rail. This advantageously acts to minimize seal wear, increase cycle times and minimize the potential for jamming.

From the foregoing disclosure and detailed description of certain preferred embodiments, it will be readily apparent to those skilled in the art that various modifications, additions and other alternative embodiments are possible without departing from the true scope and spirit of the invention. For example, the self-aligning feature disclosed herein could also be used on a tube-and-shoe regulator as that term is understood by those skilled in the art. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A self-aligning cable-drum window regulator comprising, in combination:

a windowpane slidably mounted in a window opening of a motor vehicle door;

a rail fixedly attached to the door;

a glider slidably mounted on the rail;

a slide connected to one of the windowpane above a bottom edge of the windowpane and the glider; and a C-channel having upper and lower flanges defining a generally rectangular area snugly receiving the slide; wherein the C-channel is connected to the other of the windowpane above a bottom edge of the windowpane and the glider, allowing for at least limited fore and aft adjustment of the windowpane relative to the window opening by sliding of the slide in the C-channel.

2. The self-aligning cable-drum window regulator of claim 1 wherein the slide is attached to a rivet extending from one of the windowpane and the glider.

3. The self-aligning cable-drum window regulator of claim 1 wherein the slide can pivot in at least inboard and outboard directions relative the rivet.

4. The self-aligning cable-drum window regulator of claim 1 further comprising an equalizing slide snugly received in the C-channel, wherein the slide and the equalizing slide are positioned on substantially opposite sides of the rail.

5. The self-aligning cable-drum window regulator of claim 1 wherein the slide is connected to the glider and the C-channel is connected to the windowpane.

6. The self-aligning cable-drum window regulator of claim 1 further comprising:

fore and aft, substantially vertically extending run channels positioned along fore and aft sides of the window opening for receiving for and aft peripheral edges, respectively, of the windowpane; drive means for raising and lowering the windowpane, comprising a drive motor which imparts rotary motion to a drive drum; and at least one cable connected between the drive drum and the glider to pull the windowpane up and down in the run channels.

7. A self-aligning cable-drum window regulator comprising, in combination:

a windowpane having a bottom edge, slidably mounted in a window opening of a motor vehicle door;

an elongate rail;

a glider slidably mounted on the rail;

at least two slides connectable to one of the windowpane above the bottom edge of the windowpane and the glider; and a C-channel having upper and lower flanges defining a generally rectangular area snugly receiving the slides; wherein the C-channel is connectable to the other of the windowpane above the bottom edge of the windowpane and the glider, allowing for at least limited fore and aft adjustment of the windowpane relative to the window opening by sliding of the slides in the C-channel.

* * * * *